US007848920B2

(12) United States Patent
Lewis et al.

(10) Patent No.: US 7,848,920 B2
(45) **Date of Patent: *Dec. 7, 2010**

(54) METHOD AND SYSTEM OF DYNAMICALLY ADJUSTING A SPEECH OUTPUT RATE TO MATCH A SPEECH INPUT RATE

(75) Inventors: James R. Lewis, Delray Beach, FL (US); Peeyush Jaiswal, Boca Raton, FL (US)

(73) Assignee: Nuance Communications, Inc., Burlington, MA (US)

( * ) Notice: Subject to any disclaimer, the term of this patent is extended or adjusted under 35 U.S.C. 154(b) by 223 days.

This patent is subject to a terminal disclaimer.

(21) Appl. No.: 12/166,845

(22) Filed: Jul. 2, 2008

(65) Prior Publication Data

US 2008/0262837 A1 Oct. 23, 2008

Related U.S. Application Data

(63) Continuation of application No. 10/815,309, filed on Apr. 1, 2004, now Pat. No. 7,412,378.

(51) Int. Cl.
*G10L 21/00* (2006.01)
*G10L 13/00* (2006.01)

(52) U.S. Cl. ..... 704/211; 704/260

(58) Field of Classification Search ..... 704/211, 704/260

See application file for complete search history.

(56) References Cited

U.S. PATENT DOCUMENTS 4,979,212 A 12/1990 Yamada et al.
5,444,817 A 8/1995 Takizawa
5,974,381 A 10/1999 Kubota
6,185,329 B1 2/2001 Zhang et al.
6,205,420 B1 3/2001 Takagi et al.
6,226,615 B1 5/2001 Kirby et al.
6,260,011 B1 7/2001 Heckerman et al.
6,446,041 B1 9/2002 Reynar et al.
6,484,138 B2 11/2002 DeJaco
6,490,553 B2 12/2002 Van Thong et al.
7,412,378 B2 * 8/2008 Lewis et al. ..... 704/211
2002/0116188 A1 8/2002 Amir et al.

* cited by examiner

*Primary Examiner*—Angela A Armstrong
(74) *Attorney, Agent, or Firm*—Wolf, Greenfield & Sacks, P.C.

(57) ABSTRACT

A method (10) and system of adjusting a speech output rate to match a speech input rate can include the steps of receiving (12) speech input, computing (14) a speech input rate, and dynamically adjusting (18 or 26) a speech output rate to match the speech input rate. If the type of speech output is TTS, then a rate of TTS can be adjusted (18). If the type of speech output is recorded and alternate text is available, then steps (22 and 24) of counting alternate text available from a recorded output and determining an audio file length is used to compute a default output rate to adjust a recorded output rate. If the type is recorded and alternate text is unavailable, then steps (21 and 24) of obtaining an output word count from a transcription of a recorded speech output and determining an audio file length is used.

8 Claims, 1 Drawing Sheet

METHOD AND SYSTEM OF DYNAMICALLY ADJUSTING A SPEECH OUTPUT RATE TO MATCH A SPEECH INPUT RATE

CROSS REFERENCE TO RELATED APPLICATIONS

This application is a continuation of, and accordingly claims the benefit from, U.S. patent application Ser. No. 10/815,309, now issued U.S. Pat. No. 7,412,378, which was filed in the U.S. Patent and Trademark Office on Apr. 1, 2004.

BACKGROUND OF THE INVENTION

1. Technical Field

This invention relates to the field of speech reproduction, and more particularly to a method and system for matching the speed of speech output to a speech input in a speech application.

2. Description of the Related Art

In current speech application systems, there is no way to dynamically adjust the rate of speech output to match a user's speech input rate. In a very-high quality speech system, it would be desirable to dynamically match the rate of speech output to a user's speech input rate to make the system more comfortable and pleasant for the user. There are existing methods for adjusting speech output rates for both artificial and recorded speech, but none of these methods include the ability to match and dynamically adjust to a speech input rate.

An example of such static adjustment is illustrated in U.S. Pat. No. 6,490,553 entitled "Apparatus and method for controlling rate of playback of audio data" which discusses a method and apparatus that controls the rate of playback of audio data corresponding to a stream of speech. Using speech recognition, the rate of speech of the audio data is determined. The determined rate of speech is compared to a target rate. Based on the comparison, the playback rate is adjusted, i.e. increased or decreased, to match the target rate. Although this reference adjusts the playback rate, it is for use in the field of closed captioning video and only teaches the use of rates derived from speech recognition of the audio portion of the video to match the audio output rate to a predefined non-dynamic or fixed target rate. It fails to describe a method for dynamically and automatically matching the speed of speech output (including TTS output) to speech input in a speech application.

SUMMARY OF THE INVENTION

Embodiments in accordance with the invention can enable a method and system for dynamically and automatically adjusting a speech output rate by determining the speech input rate and matching the speech output rate to match the speech input rate. The speech input rate can be determined using a running average of the rates computed for the last n utterances. This estimate of the speech input rate can be fed back into a speech production mechanism to adjust the speech output rate to match the speech input rate for either text-to-speech (TTS) or recorded speech output.

In a first aspect of the invention, a method of dynamically and automatically adjusting a speech output rate to match an speech input rate can include the steps of receiving a speech input, computing a speech input rate from the speech input, and dynamically adjusting the speech output rate to match the speech input rate. The step of computing the speech input rate can include the step of computing a running average of the rates computed for the last n utterances of the speech input.

The method can further include the step of feeding back an estimate of the speech input rate to a speech production mechanism to adjust the speech output rate. The method can further include the step of determining a type of speech output. If the type of speech output is text-to-speech (TTS), then the method can further include the step of adjusting a rate of text-to-speech synthesis to match the speech input rate if the type of speech output is text-to-speech. If the type of speech output is recorded and alternate text is available, then the method can further include the step of counting alternate text available from a recorded output and determining an audio file length to compute a default output rate which is used to adjust a recorded output rate to match the input speech rate. Alternatively, if the type of speech is recorded and alternate text is unavailable, then the method can include the steps of obtaining an output word count from a transcription of a recorded speech output and determining an audio file length to compute a default output rate which is used to adjust a recorded output rate to match the input speech rate.

In a second aspect of the invention, a system for dynamically and automatically adjusting an speech output rate to match an speech input rate can include a memory and a processor. The processor can be programmed to receive a speech input, compute a speech input rate from the speech input, and dynamically adjust the speech output rate to match the speech input rate. The processor can be further programmed to determine a type of speech output. The processor can be programmed to adjust a rate of text-to-speech synthesis to match the speech input rate if the type of speech output is text-to-speech. The processor can also be programmed to count alternate text available from a recorded output and determine an audio file length to compute a default output rate which is used to adjust a recorded output rate to match the input speech rate when the type of speech is recorded and alternate text is available. The processor can also be programmed to obtain an output word count from a transcription of a recorded speech output and determine an audio file length to compute a default output rate which is used to adjust a recorded output rate to match the input speech rate when the type of speech is recorded and alternate text is unavailable.

In a third aspect of the invention, a computer program has a plurality of code sections executable by a machine for causing the machine to perform certain steps as described in the method and systems outlined in the first and second aspects above.

BRIEF DESCRIPTION OF THE DRAWINGS

There are shown in the drawings embodiments which are presently preferred, it being understood, however, that the invention is not limited to the precise arrangements and instrumentalities shown.

DETAILED DESCRIPTION OF THE INVENTION

Figure 1:
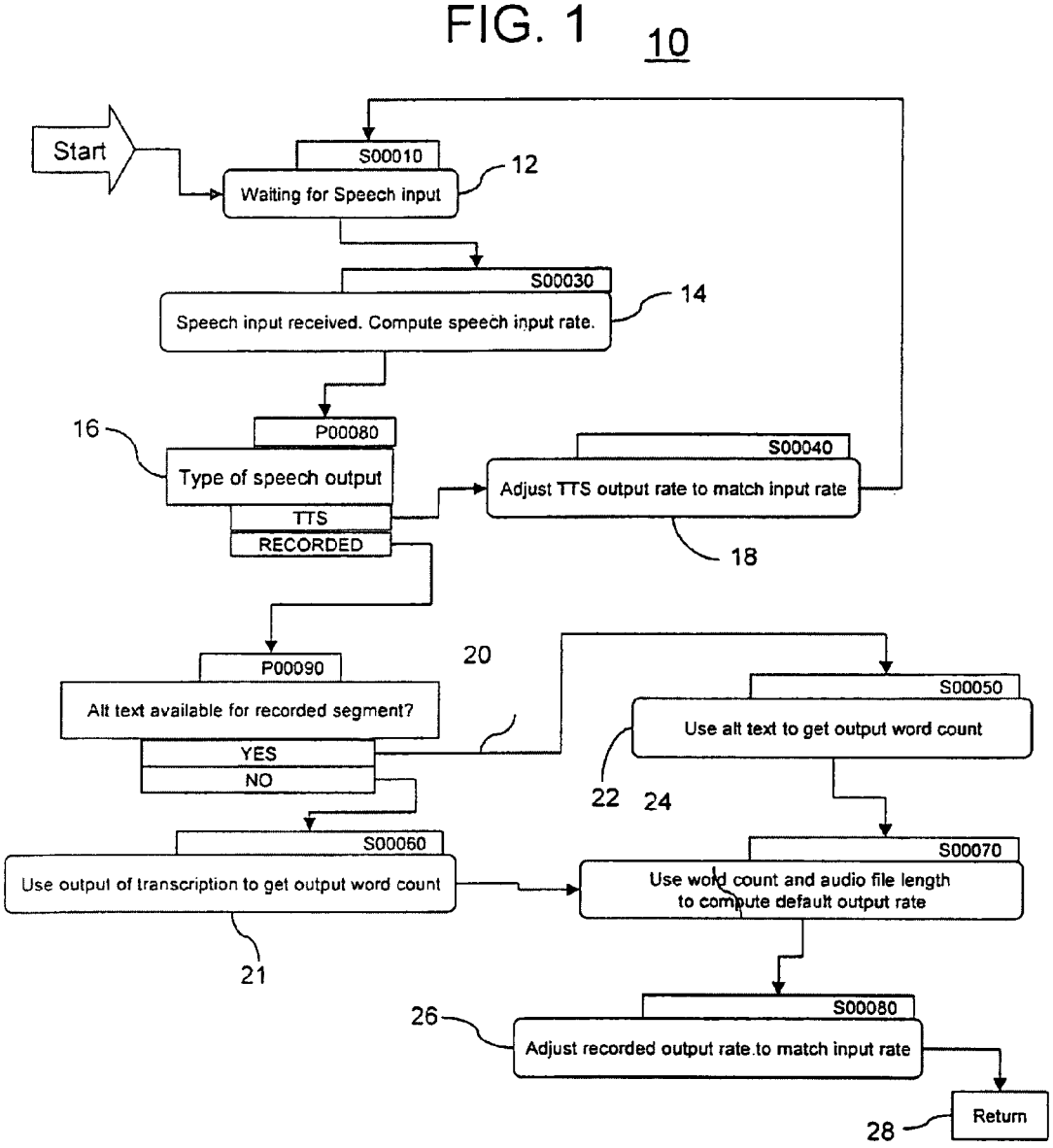
FIG. 1 is a flow diagram illustrating a method of dynamically and automatically matching the speed of a speech output to a speech input in accordance with the present invention.

Embodiments in accordance with the invention can determine a user's speech input rate and use such information to dynamically and automatically adjust the speech output rate. Referring to FIG. 1, a high-level flowchart of a method 10 haying a plurality of callflow elements or steps in accordance with the present invention is shown.

The method 10 begins by waiting for speech input at step 12 and computing, the speech input rate at step 14. The output of any speech recognition step can be the production of a text string. As a background process, the text string along with information about the amount of time required to produce the text string can be used to compute a speech input rate in words per minute for example. As an enhancement to ensure stability of estimated input rates, a running average of the rates computed for the last n utterances can be used as the measure of a speech input rate. This estimate of speech input rate can then be fed back (as shown after an adjustment step 18) into the speech production mechanism to adjust the speech output rate. This is fairly easy for speech generated via a text-to-speech engine, but is a little more complicated for recorded speech. Thus, once the speech input rate is determined, the type of speech output should be determined at step 16. If the speech input is TTS, the TTS output rate can be adjusted to match the input rate at step 18.

If the output speech is recorded at step 16, then the number of words in the output can be determined by two different methods. If the code for the output speech includes the output text (for example, alt text included as part of an <audio> tag in VOICEXML™) at step 20, then it's easy to determine the number of words in the segment by using the alternate text to get an output word count at step 22. Using the word count and an audio file length, a default output rate can be determined at step 24. If there is no alternate text available for the recorded segment at step 20, then the segment could be decoded by a transcription server (or similar program) to estimate the number of words in the segment at step 21. After determining (or estimating) the number of words in the recorded segment, the speech output rate can be computed by dividing the number of words in the text by the length of the recorded segment (which is a property of the audio file) at step 24. After computing the default output rate, the recorded output rate can be adjusted to match the input rate at step 26. Using known technologies (for example, PSOLA), it is possible to change the speed of production of recorded speech without changing the fundamental frequency of the voice.

It should be understood that the present invention can be realized in hardware, software, or a combination of hardware and software. The present invention can also be realized in a centralized fashion in one computer system, or in a distributed fashion where different elements are spread across several interconnected computer systems. Any kind of computer system or other apparatus adapted for carrying out the methods described herein is suited. A typical combination of hardware and software can be a general purpose computer system with a computer program that, when being loaded and executed, controls the computer system such that it carries out the methods described herein.

The present invention also can be embedded in a computer program product, which comprises all the features enabling the implementation of the methods described herein, and which when loaded in a computer system is able to carry out these methods. Computer program or application in the present context means any expression, in any language, code or notation, of a set of instructions intended to cause a system having an information processing capability to perform a particular function either directly or after either or both of the following: a) conversion to another language, code or notation; b) reproduction in a different material form.

This invention can be embodied in other forms without departing from the spirit or essential attributes thereof. Accordingly, reference should be made to the following claims, rather than to the foregoing specification, as indicating the scope of the invention.

What is claimed is:

1. A system for dynamically and automatically adjusting a speech output rate to match a speech input rate, the system comprising:

a memory; and a processor programmed: to receive a speech input, compute a speech input rate from the speech input, determine whether a type of speech output to be provided at the speech output rate is text-to-speech or recorded speech output, and dynamically adjust the speech output rate to match the speech input rate, wherein the processor is programmed to adjust the speech output rate based upon the type of speech output, and wherein the process is further programmed to determine, if the type of speech is recorded, whether alternate text is available, and if alternate text is available, to count the alternate text available from a recorded output and determine an audio file length to compute a default output rate which is used to adjust a recorded output rate to match the input speech rate.

2. The system of claim 1, wherein the processor is further programmed to adjust a rate of text-to-speech synthesis to match the speech input rate if the type of speech output is text-to-speech.

3. The system of claim 1, wherein the processor is further programmed to obtain an output word count from a transcription of a recorded speech output and determine an audio file length to compute a default output rate which is used to adjust a recorded output rate to match the input speech rate when the type of speech is recorded and alternate text is unavailable.

4. The system of claim 1, wherein the processor is further programmed to compute a running average of the rates computed for the last n utterances of the speech input when computing the speech input rate.

5. The system of claim 1, wherein the processor is further programmed to feed back an estimate of the speech input rate to a speech production mechanism to adjust the speech output rate.

6. A machine-readable storage, having stored thereon a computer program having a plurality of code sections executable by a machine for causing the machine to perform the steps of receiving a speech input, computing a speech input rate from the speech input, determining whether a type of speech output to be provided at the speech output rate is text-to-speech or recorded speech output, and dynamically adjusting the speech output rate to match the speech input rate, wherein the machine-readable storage is programmed to cause the machine to adjust the speech output rate based upon the type of speech output, and wherein the machine-readable storage is further programmed to determine, when the type of speech is recorded, whether alternate text is available, and if alternate text is available, to count the alternate text available from a recorded output and determine an audio file length to compute a default output rate which is used to adjust a recorded output rate to match the input.

7. The machine-readable storage of claim 6, wherein the machine-readable storage is further programmed to adjust a rate of text-to-speech synthesis to match the speech input rate if the type of speech output is text-to-speech.

8. The machine-readable storage of claim 6, wherein the machine-readable storage is further programmed to obtain an output word count from a transcription of a recorded speech output and determine an audio file length to compute a default output rate which is used to adjust a recorded output rate to match the input speech rate when the type of speech is recorded and alternate text is unavailable.

* * * * *